US005640830A

United States Patent [19]

Jabalee et al.

[11] Patent Number: 5,640,830

[45] Date of Patent: Jun. 24, 1997

[54] PACKAGING TAPE APPLICATOR AND METHOD OF AUTOMATICALLY APPLYING PACKAGING TAPE

[76] Inventors: David J. E. Jabalee, 7860 Heritage Rd., Brampton, Ontario, Canada, L6V 3N2; Colin K. Weston, 1204 Dreamcrest Rd., Mississauga, Ontario, Canada, L5V 1N7

[21] Appl. No.: 552,228

[22] Filed: Nov. 2, 1995

[51] Int. Cl.[6] ..... B65B 27/00

[52] U.S. Cl. ..... 53/397; 53/448; 53/531; 53/580

[58] Field of Search ..... 53/397, 412, 415, 53/419, 448, 133.8, 136.1, 137.2, 531, 580, 586, 48.7, 398

[56] References Cited

U.S. PATENT DOCUMENTS

| | | | |
|---|---|---|---|
| 1,468,333 | 9/1923 | Thom | 53/415 |
| 2,895,272 | 7/1959 | Krukonis | 53/397 |
| 2,925,946 | 2/1960 | Graver | 53/136.1 |
| 2,946,164 | 7/1960 | Potts et al. | 53/448 |
| 3,908,332 | 9/1975 | Ebbinghaus et al. | 53/48.7 |
| 4,454,704 | 6/1984 | Ullman | 53/580 |
| 4,589,946 | 5/1986 | Borrow | 53/580 |
| 5,423,161 | 6/1995 | Huson et al. | 53/133.8 |

FOREIGN PATENT DOCUMENTS

| | | | |
|---|---|---|---|
| 635563 | 11/1963 | Belgium | 53/580 |

*Primary Examiner*—Linda Johnson
*Attorney, Agent, or Firm*—Donald E. Hewson

[57] ABSTRACT

A packaging tape applicator for automatically applying packaging tape to groups of juxtaposed containers travelling along a conveyor comprises a gate mechanism movable between a holding position and a delivery position, for apportioning a continuous supply of individual containers into consecutive groups. Indexing means move along the conveyor in synchronized relation to the gate mechanism such that the indexing means are disposed in separating relation one between each consecutive pair of groups of juxtaposed containers. First and second packaging tape applicator mechanisms are positioned on opposite sides of the packaging tape applicator to apply first and second lengths of packaging tape to the groups of juxtaposed containers. First and second cutting mechanisms move in synchronized relation to the indexing means to cut the packaging tape, thereby separating the taped groups of juxtaposed containers one from another. A container packaging system is produced, wherein a plurality of like-size containers are secured together in a group by the first and second lengths of packaging tape. The method for automatically applying packaging tape to groups of juxtaposed containers travelling along a conveyor, comprises the steps of receiving a continuous supply of individual containers, apportioning the individual containers into groups, retaining consecutive pairs of the groups during travel along the conveyor, applying a first and second lengths of packaging tape to the containers, along opposed sides, and cutting the lengths of packaging tape.

18 Claims, 7 Drawing Sheets

PACKAGING TAPE APPLICATOR AND METHOD OF AUTOMATICALLY APPLYING PACKAGING TAPE

FIELD OF THE INVENTION

This invention relates to packaging tape applicators for automatically applying packaging tape to groups of boxes, and more specifically to such machines for applying packaging tape to groups of drinking boxes and the like, such that the drinking boxes are readily separable one from the other. Further, this application is directed to a cutting mechanism for cutting the tape between the groups of boxes.

BACKGROUND OF THE INVENTION

It is common for marketing purposes to bundle together like packages of products, such as small boxes or containers into groups of perhaps three to six, or even more. Such bundling is often done for small products that typically would be sold in bundled groups.

One common example of such a product is a drinking box, commonly known as a Tetra-pak™ wherein a cardboard or similar paper product box has been made "waterproof" and is used to hold juice or the like. Such drinking boxes are held securely together by means of plastic shrink wrap sleeve covering the exterior of all three boxes, except possibly for a portion of the ends of the two end drinking boxes. Conventionally, the three drinking boxes are juxtaposed one to another in side-by-side relation, so that their faces are visible. Such a group of three drinking boxes will henceforth be referred to as a "three-pack", for the sake of convenience. Such Tetra-pak™ type drinking boxes are typically sold as "three-packs", or may be sold in trays of twenty-seven wherein nine "three-packs" are placed in a cardboard tray and securely retained in the cardboard tray by means of a large single piece of shrink wrap.

The problem with conventional Tetra-paks™ packaged in groups of three as described above, is that the shrink wrap packaging sleeve is difficult to open without a suitable implement, such as scissors, a knife, or the like. Further, in order for shrink wrap to properly hold together the three drinking boxes, it must virtually surround the three drinking boxes. Therefore, there is a significant amount of plastic shrink wrap used for each group of three boxes. There is more plastic material used than is absolutely necessary to keep together three drinking boxes, which is therefore wasteful of plastic material and also is more costly to provide such material than is necessary.

Further, the shrink wrap, once removed from the boxes, becomes garbage, and must be disposed of accordingly, which may be difficult as drinking boxes are often used when travelling, or when out-of-doors, or in similar situations where ready garbage disposal may not be possible. Shrink wrap therefore frequently becomes discarded litter. The discarded shrink wrap becomes useless garbage, even if properly disposed of. It would, therefore, be desirable to have a means by which drinking containers could be held together by a means which is easy to open without the use of a separate implement, such as scissors or a knife, and also that generally remains with the drinking boxes, so as to not become garbage, or unwanted additional litter.

Another problem with the packaging of drinking boxes using a shrink wrap material is that the machinery to do this is relatively large, and is expensive to acquire, maintain, install, and operate. What is needed is an apparatus to secure drinking boxes together, which apparatus is relatively small, inexpensive to acquire, maintain, install and operate.

In another area of industry, it is common to bundle together a number of cigarette packages into a larger carton, for purposes of storing and shipping. The packages of cigarettes are typically retained within a foil package. This foil package tends to be somewhat expensive as it necessarily has a substantial amount of artwork on it for identification and advertising purposes. Also, the foil outer package ultimately becomes a substantial amount of waste material.

Another problem with the packaging of cigarettes as described above is that the machinery to do this is relatively large, and is expensive to acquire, maintain, install, and operate. What is needed is an apparatus to secure together packages of cigarettes into the equivalent of a carton, which apparatus is relatively small, inexpensive to acquire, maintain, install and operate.

SUMMARY OF THE INVENTION

In accordance with one aspect of the present invention, there is provided a packaging tape applicator for automatically applying packaging tape to groups of a selected number of juxtaposed containers travelling along a conveyor, the containers being substantially orthogonal in cross-section. The packaging tape applicator comprises selectively controllable drive means, and a gate mechanism connected in mechanically driven relation to the drive means so as to be movable between a holding position and a delivery position, for apportioning a continuous supply of individual containers into consecutive groups of selected members of juxtaposed containers travelling along the conveyor. Indexing means are connected in mechanically driven relation to the drive means so as to be moveable along the conveyor in synchronized relation to the gate mechanism such that the indexing means are disposed in separating relation one between each consecutive pair of groups of juxtaposed containers travelling along the conveyor. A first packaging tape applicator mechanism is positioned on the packaging tape applicator to apply a first length of packaging tape to one side of each of the groups of juxtaposed containers. A second packaging tape applicator mechanism is positioned on the packaging tape applicator to apply a second length of packaging tape to the other opposite side of each of the groups of juxtaposed containers. First and second cutting mechanisms are each connected in mechanically driven relation to the drive means so as to be moveable in a direction generally perpendicular to the direction of movement of the containers along the conveyor, in synchronized relation to the indexing means between a first withdrawn position and a second cutting position; where in the first withdrawn position, the first and second cutting mechanisms are positioned in aligned relation with one of the indexing means, and in the second cutting position, the first and second cutting mechanisms are disposed in cutting relation between a consecutive pair of groups of juxtaposed containers, so as to cut the packaging tape between the consecutive pair of groups of juxtaposed containers, thereby separating the taped groups of juxtaposed containers one from another.

In accordance with another aspect of the present invention, there is provided a container packaging system comprising a plurality of like size containers having opposed front and rear surfaces, opposed first and second side surfaces, and opposed top and bottom surfaces, the containers being disposed in juxtaposed surface-to-face relation one to the other. A first length of packaging tape is defined by a first end and a second end, and has an adhesive face and an oppositely disposed non-adhesive face, with the first length of packaging tape being secured at its adhesive face to the first side of the plurality of containers. A second length of packaging tape is defined by a first end and a second end, and has an adhesive face and an oppositely disposed non-adhesive face, with the second length of packaging tape being secured at its adhesive face to the second side of the plurality of containers. The first and second lengths of packaging tape secure the plurality of containers together in a group.

In accordance with yet another aspect of the present invention, there is provided a method for automatically applying packaging tape to groups of a selected number of juxtaposed containers travelling along a conveyor, and separating the taped groups one from another. The method comprises the steps of:

receiving a continuous supply of individual containers travelling along a conveyor;

apportioning the individual containers in the continuous supply of containers into groups of a selected number of juxtaposed containers;

retaining consecutive pairs of the groups of a selected number of juxtaposed containers during travel along the conveyor;

applying a first length of packaging tape to one side of each of the groups of juxtaposed containers;

applying a second length of packaging tape to the other opposite side of each of the groups of juxtaposed containers;

cutting the first and second lengths of packaging tape so as to separate each of the groups of juxtaposed containers from the others.

BRIEF DESCRIPTION OF THE DRAWINGS

Embodiments of this invention will now be described by way of example in association with the accompanying drawings in which.

DETAILED DESCRIPTION OF THE PREFERRED EMBODIMENTS

Figure 1:
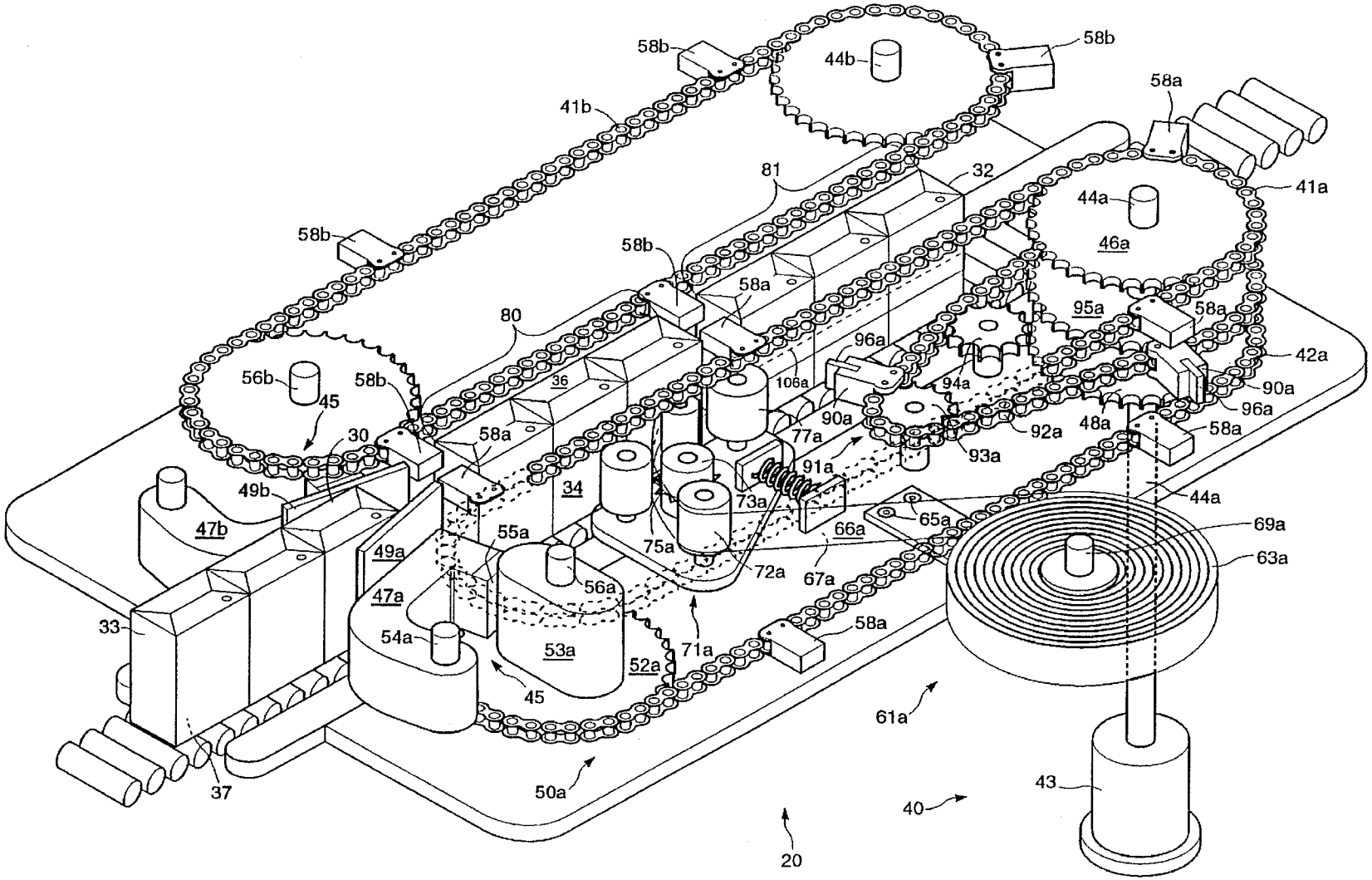
FIG. 1 is a perspective view of the preferred embodiment of the packaging tape applicator of the present invention, with one top guard and various other parts omitted for the sake of clarity.

Reference will now be made to FIGS. 1 through 5, which show the packaging tape applicator 20 of the present invention. The packaging tape applicator 20 is designed for automatically applying packaging tape to groups 80 of a selected number of like-size closed containers 30. Preferably, the groups 80 of the containers 30 each comprise the same selected number of containers 30 as each other, for the sake of ease and simplicity of production, and for the sake of conformity for subsequent packing into larger containers, among other reasons. The containers are each substantially orthogonal in cross-section and have an opposed leading face 32 and trailing face 33, an opposed first side 34 and second side 35, a top 36 and a bottom 37. Such containers 30 might be Tetra-paks™, boxed bars of soap, cereal boxes, cigarette packages, or almost any other type of cardboard box or similar, and so on. It is also conceivable that containers not having substantially orthogonal cross-sections could be taped together in the manner described herein.

In a typical application, the packaging tape applicator 20 is used for automatically applying packaging tape to groups 80 of a selected number of like-size closed containers 30 travelling along a conveyor 24 as part of an automatic production line. The packaging tape applicator 20 can be either an integral part of the actual assembly line located at an appropriate place on the conveyor, or may be placed at the conveyor, generally over top and around, so as to be readily added to an existing convention conveyor, and also to be readily removable therefrom.

It can be readily seen from the drawings, that the packaging tape applicator 20 applies packaging tape to both the first side 34 and the second side 35 of each of the boxes 30. Accordingly, most or all of the mechanisms of the packaging tape applicator 20 that are found on one side **24*a* of the conveyor 24 and are also found, in essentially a duplicated or mirror image manner, on the opposite other side 24*b* of the conveyor 24. For the sake of convenience, the subsequent detailed description will generally describe the mechanisms of the packaging tape applicator 20 on only one side 24*a* of the conveyor 24. For the sake of clarity, the letter "a" will be used as a suffix to refer to such mechanisms on one side 24*a* of the conveyor 24 and the letter "b" will be used as a suffix to refer to such duplicated mechanisms on the opposite other side 24*b* of the conveyor 24**.

The packaging tape applicator 20 comprises a selectively controllable drive means 40, which drive means 40 includes an electrical motor 43 rotatably driving a drive shaft **44*a*. A first drive gear 46*a* and a second drive gear 48*a* are mounted in mechanically driven relation on the drive shaft 44*a*. The first drive gear 46*a* and the second drive gear 48*a* are used to drive co-operating first 41*a* and second 42*a* drive chains, respectively. The first drive chain 41*a* also engages a first co-operating gear 51*a* securely mounted on a generally vertically disposed shaft 56*a*; likewise, the second drive chain 42*a* also engages a second co-operating gear 52*a*, also mounted on the shaft 56*a*. The first drive chain 41*a* is looped in engaged relation about the first drive gear 46*a* and the first co-operating gear 51*a*. The second drive chain 42*a* is looped in engaged relation about the second drive gear 48*a* and the second co-operating gear 52*a*. Idler gears (not shown) may also engage the first drive chain 41*a* and the second drive chain 42*a* in order to keep each of the first and second drive chains 41*a*, 42*a*** at a required tension.

The drive means 40 also includes an interconnecting chain (not shown) that engages a first power transfer gear (not shown) on the drive shaft **44*a* and also engages a second power transfer gear (not shown) on the drive shaft 44*b*. Motive power from the electrical motor 42 is thereby transferred to the drive shaft 44*b* and to all of the associated gears and chains on the side 24*b* of the conveyor 24, in the same manner as for the gears and chains on the side 24***a* of the conveyor 24.

Figure 2:
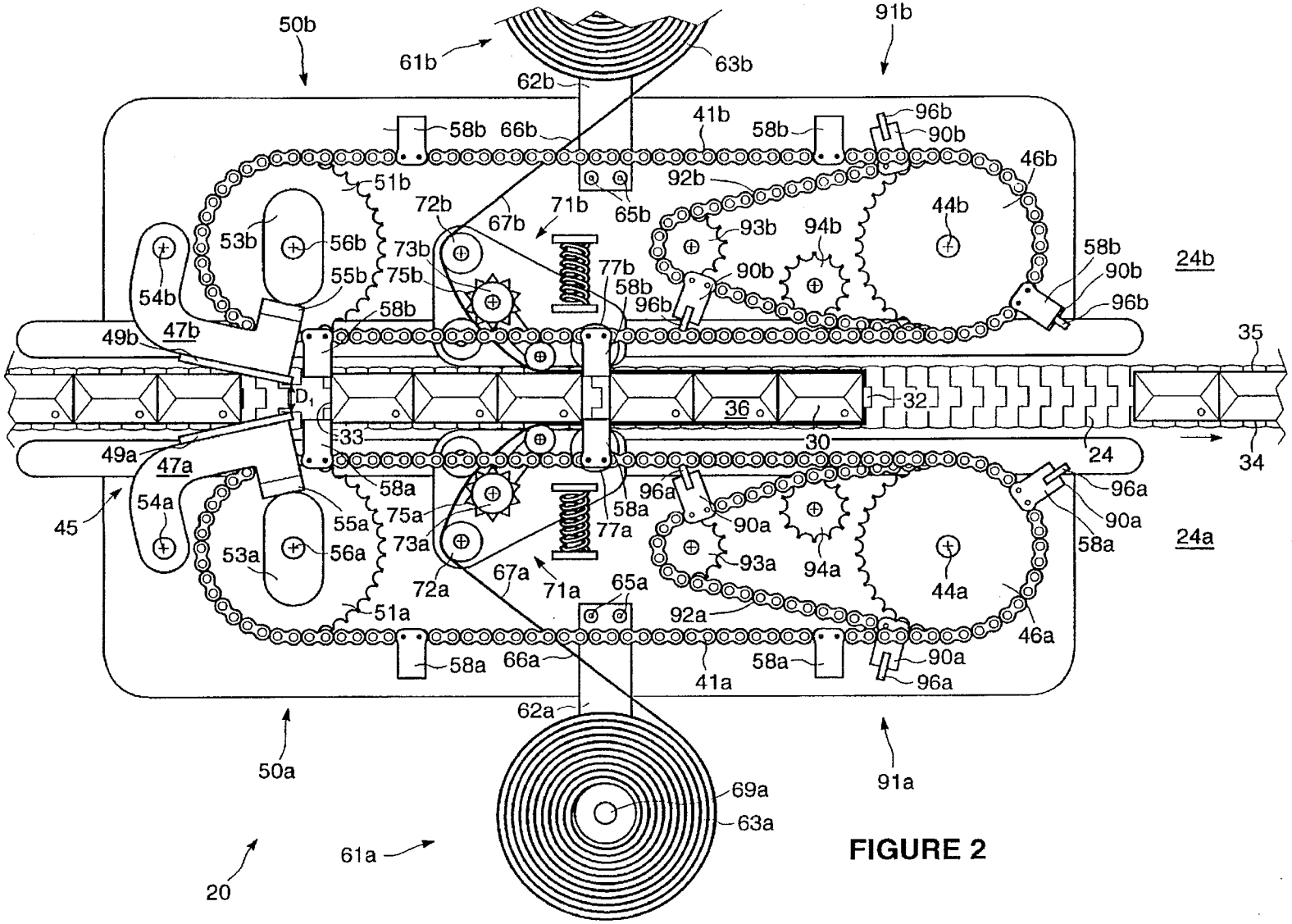
FIG. 2 is a top plan view of the packaging tape applicator of FIG. 1, with the gate mechanism shown in the holding position, and with both top guards and various other parts omitted for the sake of clarity.
Figure 3:
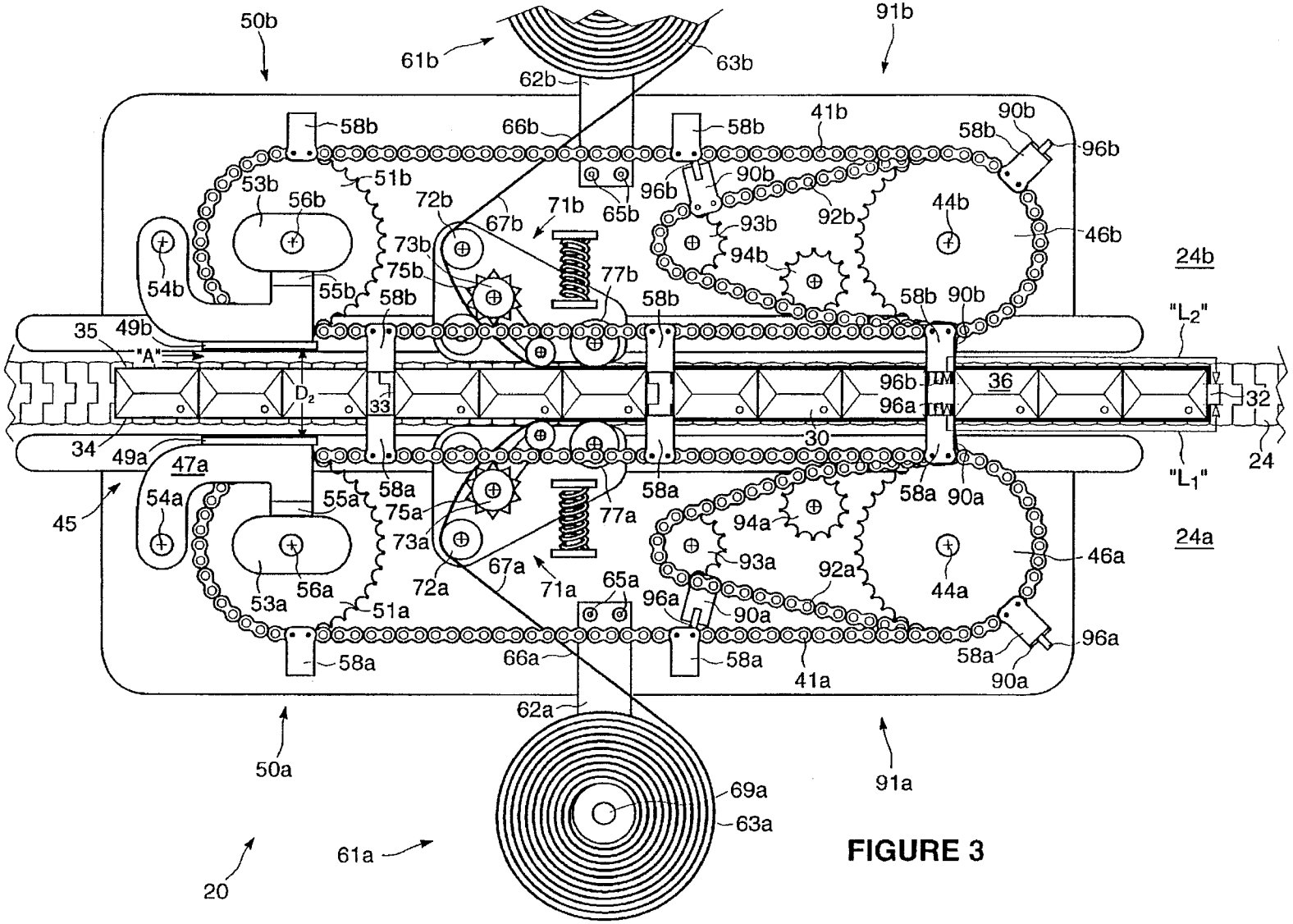
FIG. 3 is a top plan view of the packaging tape applicator of FIG. 1, with the gate mechanism shown in the delivery position, and with both top guards and various other parts omitted for the sake of clarity.
Figure 4:
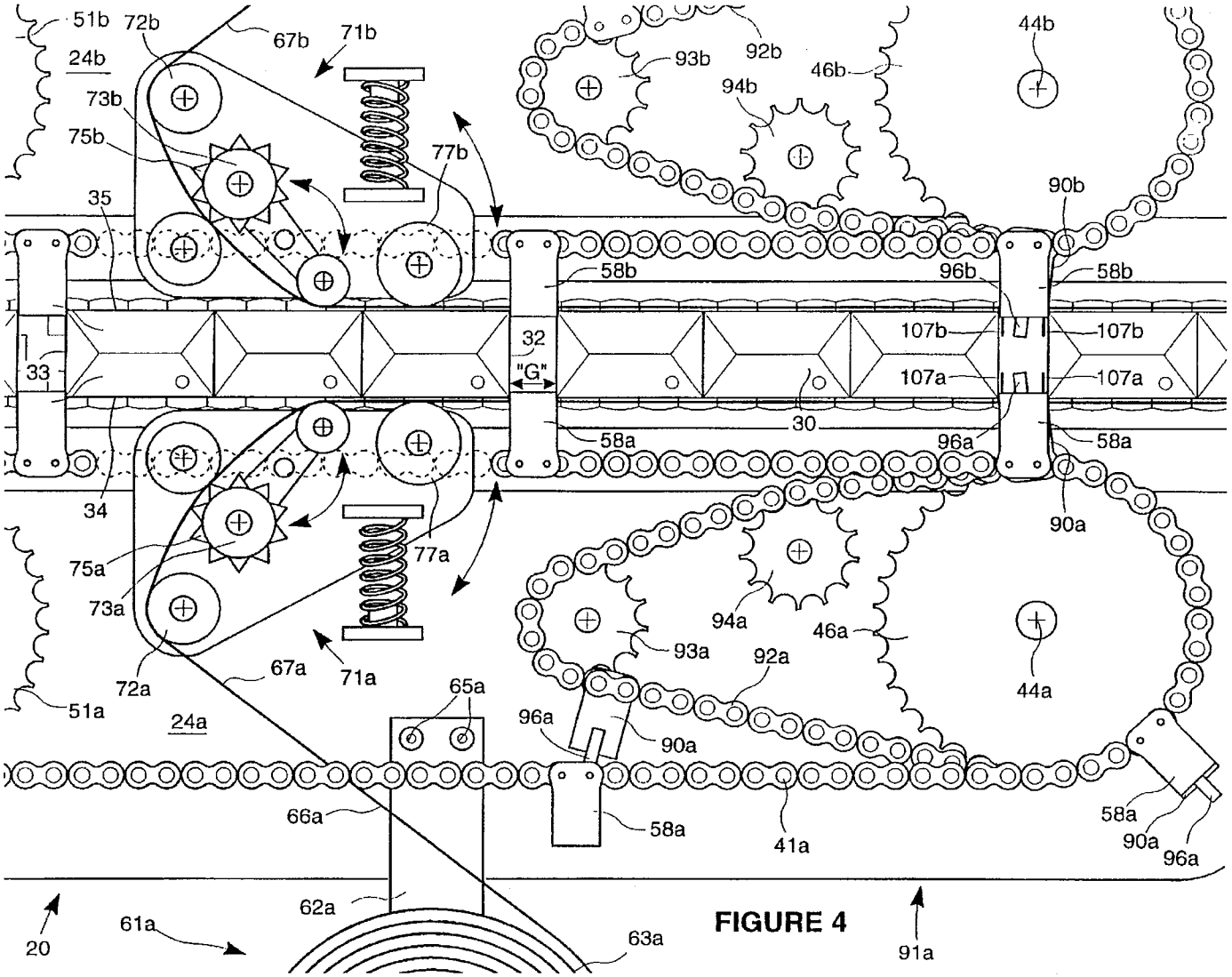
FIG. 4 is an enlarged top plan view of a portion of the packaging tape applicator of FIG. 1, with both top guards and various other parts omitted for the sake of clarity.

A gate mechanism 45 is used to regulate the passage of containers 30 travelling along the conveyor 24 into the packaging tape applicator 20. The gate mechanism 45 comprises a pair of pivotally mounted opposed arms 47*a* and 47*b*, with hands 49*a* and 49*b* securely attached one each to the arms 47*a* and 47*b* respectively. The hands 49*a* and 49*b* are shaped and positioned to block the containers 30, as will be described in greater detail subsequently. The arms 47*a* and 47*b* are substantially identical in form and function one to the other. Accordingly, for the sake of convenience, generally the mounting and operation of arm 47*a* and its related mechanisms only will be discussed, as appropriate. The arm 47*a* is pivotally mounted on the main frame 22 of the packaging tape applicator 20 by means of a vertically disposed mounting post 54*a*. The arm 47*a* is connected in mechanically driven relation to the selectively controllable drive means 40 by means of a cam member 53*a*. The cam member 53*a* is mounted on the main frame 22 by means of the shaft 56*a*. The cam member 53*a* is rotated by the shaft 56*a*, as driven by the first and second co-operating gears 51*a* and 52*a*. The cam member 53*a* bears against a cam follower surface 55*a* on the outer portion of the arm 47*a*, which arm 47*a* is thereby pivotally moved between a holding position, as shown in FIG. 2, and a delivery position, as shown in FIG. 3. In the holding position, the distance "$D_1$" between the hands 49*a* and 49*b* of the two arms 47*a* and 47*b* is slightly less than the thickness of a container 30, which thickness is defined as the distance between the first side 34 and the second side 35. Accordingly, a container 30 is precluded from passing between the two hands 49*a* and 49*b*. In the delivery position, the distance "$D_2$" between the two hands 49*a* and 49*b* of the two arms 47*a* and 47*b* is slightly greater than the thickness of the containers 30. Accordingly, the containers 30 are allowed to pass therethrough. In use, the two arms 47*a* and 47*b* are moved between their holding position and their delivery position, as will be discussed in greater detail subsequently, for apportioning a continuous supply of individual containers 30 into consecutive groups 80 of a selected number of juxtaposed containers 30, which consecutive groups 80 travel along the conveyor 24.

An indexing means 50*a* comprises a plurality of finger members 58*a* securely mounted in outwardly projecting relation on the first drive chain 41*a*, in equally spaced relation therealong, and a plurality of finger members 58*a* securely mounted in outwardly projecting relation on the second drive chain 42*a*, in equally spaced relation therealong. The finger members 58*a* on the second drive chain 42*a* are mounted so as to be in vertical alignment each with a corresponding one of the plurality of the finger members 58*a* on the first drive chain 41*a*. In this manner, one of the plurality of finger members 58*a* on the first drive chain 41*a* and a correspondingly vertically aligned finger member 58*a* are disposed between consecutive groups 80 of juxtaposed containers 30 in order to index the consecutive groups 80 of juxtaposed containers by way of maintaining a gap of known size therebetween. Finger members 58*a* are kept in alignment one with the other as they travel along the conveyor 24, by the fact that the first drive chain 41*a* and the second drive chain 42*a* are driven in synchronization one to the other by means of the drive shaft 44*a* rotating the first drive gear 46*a* and the second drive gear 48*a* in unison, one with the other.

A first packaging tape support means 61*a* and a second packaging tape support means 61*b* are disposed on the packaging tape applicator 20 at opposite sides of the conveyor 24, respectively. In the preferred embodiment, the first packaging tape support means 61*a* comprises a bracket member 62*a* secured to the main frame 22 of the packaging tape applicator by means of machine screws 65*a*. A freely rotating spindle 69*a* extends upwardly from the outer portion of the bracket member 62*a*. A first roll of packaging tape 63*a*, comprising perhaps one thousand feet of packaging tape, is mounted on the rotating spindle 69*a*, so that the tape may be released therefrom as will be discussed in greater detail subsequently. The first roll of packaging tape 63*a* is thereby supported by the first packaging tape support means 61*a*. Similarly, the second packaging tape support means 61*b* operatively supports a second roll of packaging tape 63*b* in a similar manner to that described above for the first roll of packaging tape 63*a*.

A first packaging tape applicator mechanism 71*a* is disposed on the packaging tape applicator 20 at one side 24*a* of the conveyor 24, and a second packaging tape applicator mechanism 71*b* is disposed on the packaging tape applicator 20 at the opposite other side 24*b* of the conveyor 24. The first packaging tape applicator mechanism 71*a* comprises a freely rotating guide wheel 72*a*, a freely rotating cutting wheel member 73*a* having a centrally disposed cutting blade 75*a*, which cutting blade 75*a* cuts a plurality of tear inducing cuts 106*a* into the unreeled section 67*a* of packaging tape from the first roll of packaging tape 63*a*. A spring biased applicator wheel 77*a* ensures correct tape tension as the tape is applied to the containers 30. As the consecutive groups 80 of the juxtaposed containers 30 pass by the applicator wheel 77*a*, along the conveyor 24, a portion of the adhesive side 66*a* of the unreeled section 67*a* of the first roll of packaging tape 63*a* is applied by the applicator wheel 77*a* to the first side 34 of each of the containers 30 of the consecutive groups 80 of juxtaposed containers 30. In this manner, taped groups 81 of juxtaposed containers 30 are formed. In the preferred embodiment, the taped groups 81 of containers 30 each comprise the same selected number of containers 30 as each other. Each taped group 81 has a leading face 82, a trailing face 83, a first taped side 84, a second taped side 85, a top 86, and a bottom 87.

In a manner analogous to that described above, the second packaging tape applicator mechanism 71*b* applies packaging tape from the second roll of packaging tape 63*b* to the second sides 35 of the containers 30.

It can be seen that the packaging tape that is used is initially conventional packaging tape, and that just before it is applied to the containers 30, a plurality of tear inducing cuts are created in the packaging tape. Such perforated packaging tape and dispenser and a perforation mechanism therefor are the subject of co-pending U.S. patent application Ser. No. 08/386,540 by the present inventors.

A first cutting mechanism 91*a* and a second cutting mechanism 91*b* are each mounted in operative relation on the packaging tape applicator 20 so as to be moveable in synchronized relation to the indexing means 50*a*. The first cutting mechanism 91*a* comprises a plurality of cutting elements 90*a* securely mounted in outwardly projecting relation on a third drive chain 92*a*. Each of the cutting elements 90*a* is made from a suitable plastic material, such as nylon, and comprises a substantially convex leading edge 96*a* and has three small cutting blades 97*a*, 98*a*, 99*a* projecting slightly outwardly from the substantially convex leading edge 96*a*. Each of the three small cutting blades 97*a*, 98*a*, 99*a* may be serrated or sharp, as necessary, in order to pierce the packaging tape, thus causing the packaging tape to tear generally across its width.

The cutting elements 90*a* are mounted on the third drive chain 92*a* in equally spaced relation therealong so as to vertically align each of the cutting elements 90*a* with a corresponding one of the plurality of the finger members 58*a* on the first drive chain 41*a* and second drive chain 42*a*. In this manner, the cutting elements 90*a* can extend between two consecutive taped groups 81 of juxtaposed containers 30, as will be discussed in greater detail subsequently.

The third drive chain 92*a* is looped in engaged relation about a third drive gear 95*a*, which third drive gear 95*a* is mounted in mechanically driven relation on the drive shaft 44*a*. The third drive gear 95*a* is the same diameter as the first drive gear 46*a* and the second drive gear 48*a*, and accordingly, the third drive gear 95*a* rotates at the same speed as the first drive gear 46*a* and the second drive gear 48*a*. The third drive chain 92*a* is also looped in engaged relation about a freely rotating third co-operating gear 93*a* and a freely rotating fourth co-operating gear 94*a*. The third freely rotating co-operating gear 93*a* generally positions the third drive chain 92*a* for travel generally along the side 24*a* of the conveyor 24. The fourth co-operating operating gear 94*a* is disposed in such a position so as to urge the cutting elements 90*a* on the third drive chain 92*a* sequentially from a first withdrawn position to a second cutting position. In the first withdrawn position, the first cutting mechanism 91*a* is positioned in aligned relation with one of the indexing means 50*a*, actually between two of the aligned finger members 58*a* on the first drive chain 41*a* and the second drive chain 42*a*. The cutting elements 90*a* travel along the conveyor 24 in synchronized relation with the finger members 58*a*—that is to say, that they move along the conveyor 24 at the same speed as the finger members 58*a*. In order to accomplish this, the third drive gear 95*a* is of the same diameter and has the same number of teeth as the first drive gear 46*a* and the second drive gear 48*a*. Moreover, the first drive chain 41*a*, the second drive chain 42*a*, and the third drive chain 92*a* all have links of the same length.

As each of the cutting elements 90*a* reaches the fourth co-operating gear 94*a*, the specific cutting element 90*a* is moved inwardly by the fourth co-operating gear 94*a* towards taped groups 81 of juxtaposed boxes 30, or more specifically toward the gap between consecutive taped groups 81, until the cutting element 90*a* is in the second cutting position. In the second position, the first cutting mechanism 91*a* is disposed in cutting relation between consecutive taped groups 81 of juxtaposed containers 30, so as to cut the unreeled section 67*a* of the first roll of packaging tape 63*a*, between the consecutive taped groups 81 of juxtaposed containers 30. In this manner, a first length 101*a* of packaging tape is formed on the first taped side 84 of each of the taped groups 81 of juxtaposed containers 30. As discussed previously, the first length of packaging tape 101*a* includes a plurality of tear inducing cuts 106*a* therein disposed along the length "L" thereof, as introduced into the first length of packaging tape 101*a* by the cutting element 90*a*, as discussed above.

The structure and operation of the second cutting mechanism 91*b* is analogous to the first cutting mechanism 91*a*, as described above.

In use, a continuous supply of individual containers 30 travels along the conveyor 24 in a direction indicated by arrow "A", into the gate mechanism 45. The arms 47*a* and 47*b* of the gate mechanism 45 periodically moves between its holding position, whereat the containers 30 are precluded from moving past the gate mechanism 45 to a delivery position, whereat the containers are permitted to pass by the gate mechanism 45. The period of movement of the gate mechanism 45 is equal to the length of a taped group 81 of juxtaposed containers 30, as measured from the leading face 82 to the trailing face 83, plus the desired gap between consecutive taped groups 81 of juxtaposed containers 30 on the conveyor 24, times two, divided by the speed of travel of the containers 30 along the conveyor 24. As discussed previously, the arms 47*a* and 47*b* of the gate mechanism 45 are moved between their holding position and their delivery position by cam members 53*a* and 53*b*, which cam members 53*a* and 53*b* rotate in unison with the first co-operating gears 51*a* and 51*b*. The speed of rotation of the cam is determined by the speed of the first drive chain 41*a*, and also by the size of the first co-operating gear 51*a* and the number of teeth thereon. Accordingly, the speed of the rotation of the cam is synchronized with the speed of travel of the first 41*a* and the second 42*a* drive chains, and is controlled by the selectively controllable drive means 40.

The effective circumference of the first co-operating gear 51*a* is equal to the sum of the length of a taped group 81 of juxtaposed containers 30, as measured from the leading face 82 to the trailing face 83, plus the desired gap between consecutive taped groups 81 of juxtaposed containers 30 on the conveyor 24, times two. This calculation assumes a double lobed cam, as shown in the Figures.

Figure 5:
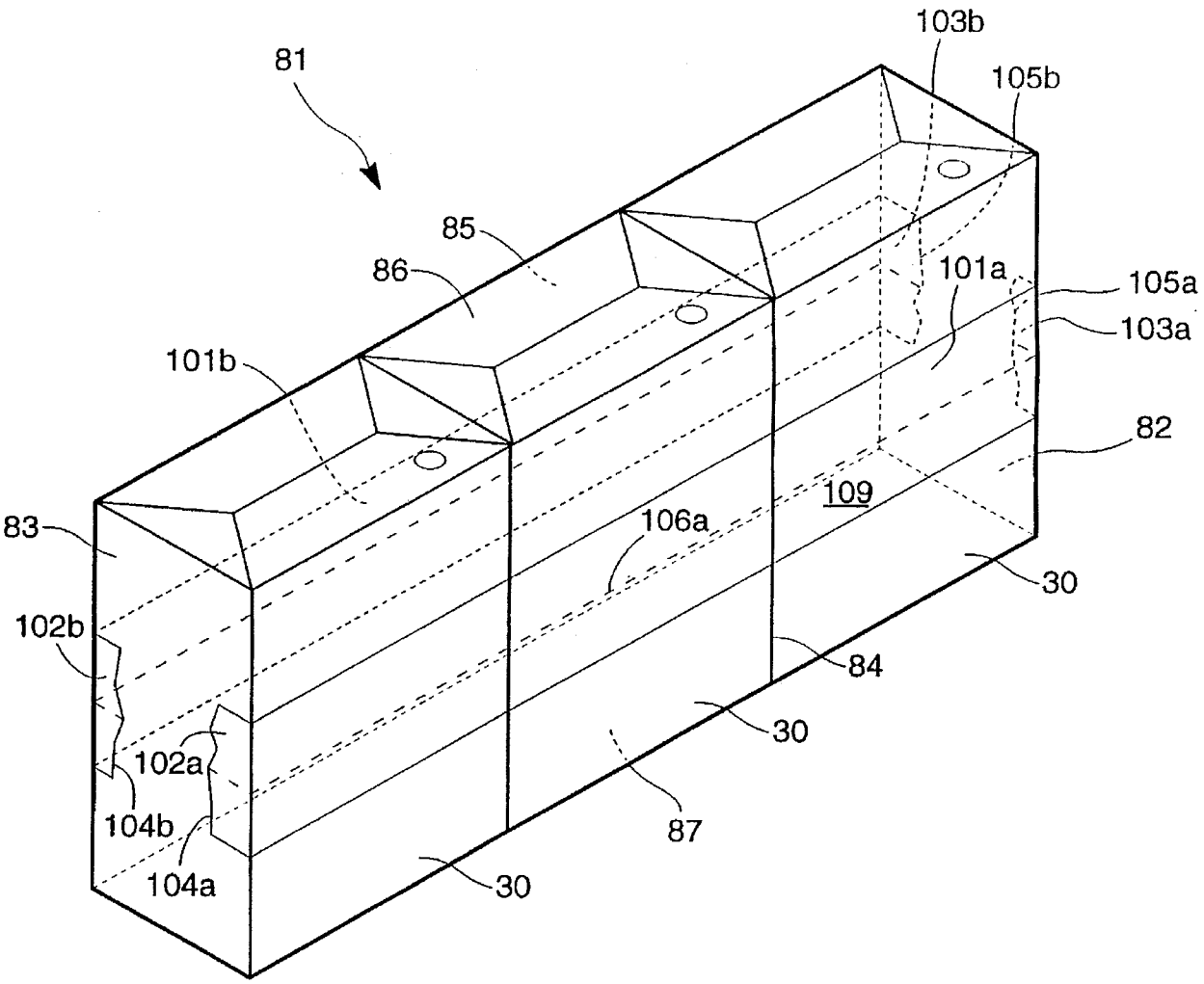
FIG. 5 is a perspective view of three like-size containers secured together by first and second lengths of packaging tape.

When the gate mechanism 45 is in its delivery position, a selected number—three, in the preferred embodiment—containers 30 are permitted to pass through the gate mechanism 45. Upon leaving the gate mechanism 45, one finger member 58*a* on each of the first drive chain 41*a* and second drive chain 42*a* come up behind the three containers 30, so as to keep the containers 30 together as a group. Unreeled sections 67*a*, 67*b* of packaging tape are then applied to the first sides 34 and second sides 35, respectively, of the containers 30 by the applicator wheel 77*a*. The cutting elements 90*a* that is aligned with the particular finger members 58*a* are then forced inwardly into the gap between the groups 80 of juxtaposed containers 30, from their first withdrawn position to their second cutting position, so as to cut the unreeled section 67*a*, 67*b*, of the respective of the first roll of packaging tape 63*a* and second roll of packaging tape 63*b*. The cutting elements 90*a* are preferably of a width and shape so as to contact the trailing face 83 of one taped group 81 of juxtaposed containers 30, and also the leading face 82 of the next group 80 of juxtaposed containers 30. In this manner, the end portion 102*a* of the first length of packaging tape 101*a* and the end portion 102*b* of the second length of packaging tape 101*b* are wiped onto the trailing face 33 of the trailing end container 30 of the taped group 81 of juxtaposed containers 30, and the end portion 103*a* of the first length of packaging tape 101*a* and the end portion 103*b* of the second length of packaging tape 101*b* are wiped onto the leading face 32 of the leading end container of the next taped group 81 of juxtaposed containers 30. It can be seen that the wiping of the end portions 102*a*, 102*b*, 103*a*, 103*b* of the first 101*a* and second 101*b* lengths of packaging tape onto the respective of the leading 32 and the trailing 33 faces of the two end containers is performed as an ongoing continuation of the step of cutting the unreeled sections 67*a*, 67*b* of the first 63*a* and second 63*b* rolls of packaging tape between consecutive taped groups 81 of juxtaposed containers 30. The taped groups 81 of juxtaposed containers 30, one of which is illustrated in FIG. 5, are then removed from the packaging tape applicator 20 by the conveyor 24.

The first 101*a* and the second 101*b* lengths of packaging tape on the three containers 30 hold the three containers 30 in place until the tape is torn, or otherwise cut, so as to permit separation of the containers 30 one from the others, thus defining a container packaging system. The container packaging system comprises a plurality of like-size closed containers 30, each having opposed leading 32 and trailing 33 faces, opposed first 34 and second 35 sides, a top 36 and a bottom 37. The containers 30 are disposed in juxtaposed relation one to the other, typically in face-to-face relation or side-to-side relation. The first length of packaging tape 101*a* of length "$L_1$", defined by a first end 104*a* and a second end 105*a*, has an adhesive face 107*a* and an oppositely disposed non-adhesive face 109*a*. The first length of packaging tape 101*a* is secured at its adhesive face 107*a* to the first sides 34 of the plurality of containers 30. Similarly, the second length of packaging tape 101*b* is of length "$L_2$", defined by a first end 104*b* and second end 105*b*, and has an adhesive face 107*b* and an oppositely disposed non-adhesive face 109*b*. The second length of packaging tape 101*b* is secured at its adhesive face 107*b* to the second sides 35 of the plurality of three containers 30. The first 101*a* and second 101*b* lengths of packaging tape secure the plurality of containers 30 together in a taped group 81 of juxtaposed containers 30. The taped group 81 has a leading face 82, a trailing face 83, a first side 84, a second side 85, a top 86, and a bottom 87. The first 101*a* and second 101*b* lengths of packaging tape include a plurality of tear inducing cuts 106*a* therein, disposed along the length of each.

Figure 6:
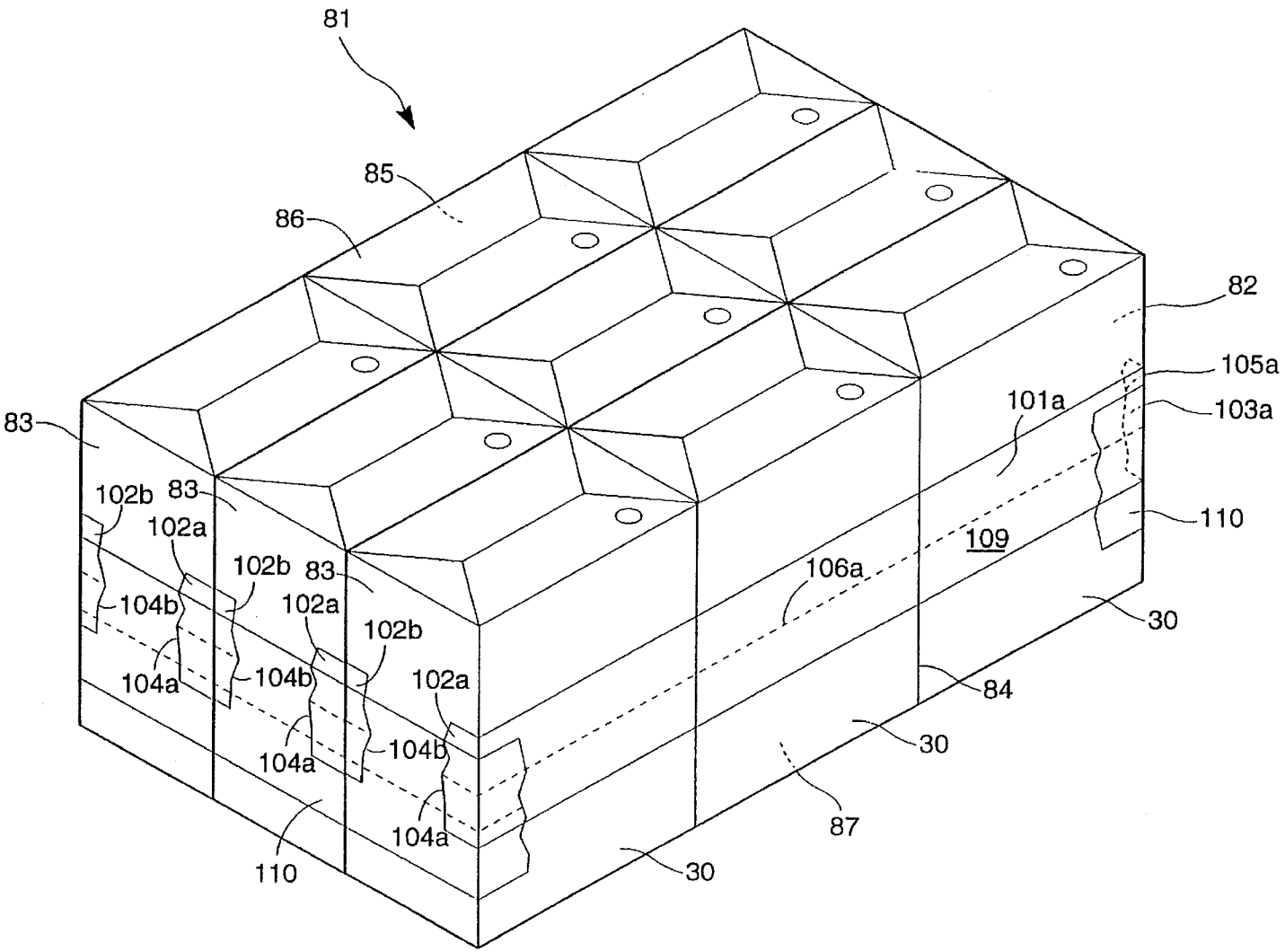
FIG. 6 is a perspective view of nine like-size three-packs of containers secured together by first and second lengths of packaging tape.

As can be best seen in FIG. 6, a plurality—in this case three—of taped groups 81 can be taped together by additional lengths of tape 110 located at the ends 84, 85 of the taped groups 81.

Figure 7:
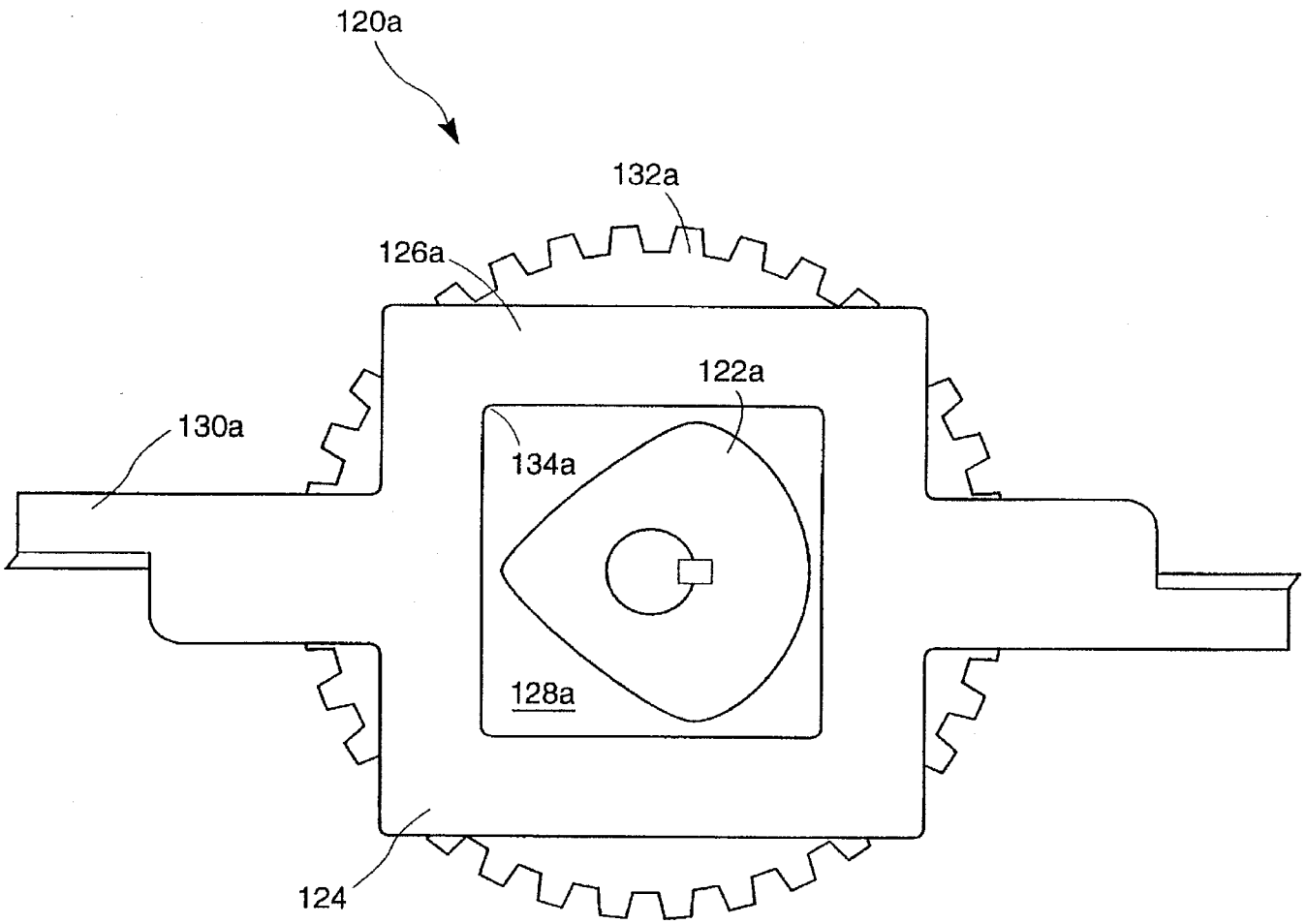
FIG. 7 is an enlarged top view of an alternative embodiment cutting mechanism.

An alternative embodiment cutting mechanism, as shown in FIG. 7, may also be employed to cut the unreeled sections 67*a*, 67*b* of the respective of the first 63*a* and second 63*b* rolls of packaging tape. One cutting mechanism 120*a* is mounted on one side 24*a* of the conveyor 24, and another similar cutting mechanism 120*b* is mounted on the other opposite side 24*b* of the conveyor 24. The alternative embodiment cutting mechanism 120*a* comprises a rotationally fixed cam member 122*a*, that is preferably tri-lobed in shape, is secured to the main frame 22 of the packaging tape applicator 20. A rotatable cutter head 124*a* has a main body portion 126*a* defining a central hollow portion 128*a* therewithin. The rotatable cutter head 124*a* fits over the rotationally fixed cam member 122*a* such that the rotationally fixed cam member 122*a* is disposed within the central hollow portion 128*a* of the main body portion 126*a*. At least one cutting blade 130*a* projects outwardly from the main body portion 126*a*. A drive link means in the form of a gear member 132*a* is disposed on the rotatable cutter head 124*a* and is operatively engagable to the drive means 40 so as to permit driving of the rotatable cutter head 124*a*.

The central hollow portion 128*a* of the rotatable cutter head 124*a* is substantially square in shape, with rounded corners 134*a*, so as to permit the rotatable cutter head 124*a* to follow the tri-lobed fixed cam member 122*a* in a manner so as to produce a desired path for the at least one cutting blade 130*a*. The shape and size of the fixed cam member 122*a* and the shape and size of the central hollow portion 128*a* of the main body portion 126*a* of the rotatable cutter head 124*a*, cause the cutting blade 130*a* to follow a path whereat the cutting blade 130*a* is moved inwardly between two consecutive groups of taped containers 81, thus cutting the portion of the first roll of packaging tape 63*a* that spans the gap "G" therebetween. This particular cutting mechanism 120*a* can achieve a very quick cutting action, and can therefore be used when a relatively high cutting force is necessary.

Other modifications and alterations may be used in the design and manufacture of the apparatus of the present invention without departing from the spirit and scope of the accompanying claims.

What is claimed is:

1. A packaging tape applicator for automatically applying packaging tape to groups of a selected number of like-size closed containers travelling along a conveyor, said containers each being substantially orthogonal in cross-section and having opposed leading and trailing faces, opposed first and second sides, a top and a bottom, said packaging tape applicator comprising:

selectively controllable drive means;

a gate mechanism connected in mechanically driven relation to said drive means so as to be movable between a holding position and a delivery position, for apportioning a continuous supply of individual containers into consecutive groups of selected numbers of juxtaposed containers travelling along said conveyor;

indexing means connected in mechanically driven relation to said drive means so as to be moveable along said conveyor in synchronized relation to said gate mechanism such that said indexing means are disposed in separating relation one between consecutive groups of juxtaposed containers travelling along said conveyor;

first and second packaging tape support means disposed on said packaging tape applicator at opposite sides of said conveyor, respectively;

first and second rolls of packaging tape supported by said first and second packaging tape support means, respectively;

first and second packaging tape applicator mechanisms disposed on said packaging tape applicator at opposite sides of the conveyor, to apply a portion of the adhesive sides of unreeled sections of the respective of said first and second rolls of packaging tape to the first and second sides respectively of each of the containers of said groups of juxtaposed containers, thus forming taped groups of juxtaposed containers, each taped group having a leading face, a trailing face, a first taped side, a second taped side, a top and a bottom;

first and second cutting mechanisms each mounted in operative relation on said packaging tape applicator so as to be moveable in synchronized relation to said indexing means between a first withdrawn position and a second cutting position; where, in said first withdrawn position, said first and second cutting mechanisms are positioned in aligned relation with one of said indexing means, and in said second cutting position, said first and second cutting mechanisms are disposed in cutting relation between consecutive taped groups of juxtaposed containers, so as to cut said unreeled sections of said first and second rolls of said packaging tape, respectively, between said consecutive taped groups of juxtaposed containers to form first and second lengths of packaging tape on said first taped side and said second taped side of each of said taped groups of juxtaposed containers.

2. The packaging tape applicator of claim 1, wherein said taped groups of containers each comprise the same selected number of containers as each other.

3. The packaging tape applicator of claim 1, wherein said indexing means comprises a plurality of finger members securely mounted in outwardly projecting relation on a first drive chain, in equally spaced relation therealong, said first drive chain being looped in engaged relation about at least a first drive gear and a first co-operating gear.

4. The packaging tape applicator of claim 3, wherein said indexing means further comprises a plurality of finger members securely mounted in outwardly projecting relation on a second drive chain, in equally spaced relation therealong so as to be in vertical alignment each with a corresponding one of said plurality of finger members on said first drive chain, said second drive chain being looped in engaged relation about at least a second drive gear and a second co-operating gear.

5. The packaging tape applicator of claim 1, wherein said first and second lengths of packaging tape include a plurality of tear-inducing cuts therein disposed so as to be generally centrally aligned collinearly along the length of each of said first and second lengths of tape.

6. The packaging tape applicator of claim 1, wherein said first and second cutting mechanisms are connected in mechanically driven relation to said drive means.

7. The packaging tape applicator of claim 1, wherein each of said first and second cutting mechanisms comprises a plurality of cutting elements securely mounted in outwardly projecting relation on a third drive chain, in equally spaced relation therealong, said third drive chain being looped in engaged relation about at least a third drive gear and a third co-operating gear so as to align each of said cutting elements in synchronized relation to a corresponding one of said plurality of finger members on said first drive chain.

8. The packaging tape applicator of claim 7, further comprising a fourth co-operating gear engaging said third drive chain, said fourth co-operating gear disposed on said packaging tape applicator so as to urge said cutting elements sequentially from said first withdrawn position to said second cutting position.

9. The packaging tape applicator of claim 8, wherein said third drive gear is connected in mechanically driven relation to said drive means.

10. The packaging tape applicator of claim 9, wherein said cutting elements each comprise a substantially convex leading edge.

11. The packaging tape applicator of claim 10, wherein said cutting elements each include three small cutting blades projecting slightly outwardly from said substantially convex leading edge.

12. The packaging tape applicator of claim 1, wherein each of said first and second cutting mechanisms comprises a rotationally fixed cam member secured to said packaging tape applicator; a rotatable cutter head having a main body portion defining a central hollow portion therewithin, and at least one cutting blade projecting outwardly from said main body portion; and drive link means on said rotatable cutter head and operatively engagable to the drive means of said packaging tape applicator so as to permit driving of said rotatable cutter head by said drive means.

13. The packaging tape applicator of claim 12, wherein said fixed cam member is tri-lobed in shape.

14. The packaging tape applicator of claim 13, wherein said central hollow portion of said rotatable cutter head is substantially square in shape with rounded corners, so as to permit said rotatable cutter head to follow said tri-lobed fixed cam, thus producing a desired path for the at least one cutting blade.

15. A method for automatically applying packaging tape to groups of a selected number of like-size closed containers travelling along a conveyor, said containers being substantially orthogonal in cross-section and each having opposed leading and trailing faces, opposed first and second sides, a top and a bottom, said method comprising the steps of:

receiving a continuous supply of individual containers travelling along said conveyor;

apportioning said continuous supply of containers into separated groups of a selected number of juxtaposed containers, with each of said groups of containers being separated in a direction along said conveyor;

retaining in separated relation said consecutive groups of a selected number of juxtaposed containers during travel along said conveyor;

applying a portion of the adhesive side of unreeled sections of the respective of first and second rolls of packaging tape to the first and second sides respectively of each of the containers of said groups of juxtaposed containers, thus forming taped groups of juxtaposed containers, a leading face, a trailing face, first and second sides, a top and a bottom;

cutting said unreeled sections of said first and second rolls of said packaging tape, respectively, between said consecutive taped groups of juxtaposed containers to form first and second lengths of packaging tape on said first and second taped sides of each of said taped groups of juxtaposed containers; and effecting a plurality of tear-inducing cuts in each of said unreeled sections of said first and second rolls of packaging tape, such that said plurality of tear-inducing cuts are ultimately disposed along the length of each of said first and second lengths of tape.

16. The method of claim 15, further comprising the step of:

wiping the end portions of said first and second lengths of packaging tape onto said leading and trailing faces of the two end containers of each of said taped groups of juxtaposed containers.

17. The method of claim 16, wherein the step of wiping the end portions of said first and second lengths of packaging tape onto said leading and trailing faces of the two end containers of each of said taped groups of juxtaposed containers, is performed as an ongoing continuation of the step of cutting said unreeled sections of said first and second rolls of said packaging tape, respectively, between said consecutive taped groups of juxtaposed containers.

18. The method of claim 15, further comprising the step of:

effecting a plurality of tear-inducing cuts in each of said unreeled sections of said first and second rolls of packaging tape, such that said plurality of tear-inducing cuts are ultimately disposed along the length of each of said first and second lengths of tape.

* * * * *